US010102841B2

(12) United States Patent
Wilson

(10) Patent No.: US 10,102,841 B2
(45) Date of Patent: Oct. 16, 2018

(54) ACOUSTIC ABSORBER AND USE OF SAID TYPE OF ACOUSTIC ABSORBER

(71) Applicant: Leena Rose Wilson, Berlin (DE)

(72) Inventor: Willsingh Wilson, Berlin (DE)

(73) Assignee: LEENA ROSE WILSON, Berlin (DE)

( * ) Notice: Subject to any disclaimer, the term of this patent is extended or adjusted under 35 U.S.C. 154(b) by 0 days.

(21) Appl. No.: 15/118,093

(22) PCT Filed: Feb. 11, 2015

(86) PCT No.: PCT/EP2015/052900
§ 371 (c)(1),
(2) Date: Sep. 9, 2016

(87) PCT Pub. No.: WO2015/121319
PCT Pub. Date: Aug. 20, 2015

(65) Prior Publication Data

US 2016/0379616 A1 Dec. 29, 2016

(30) Foreign Application Priority Data

Feb. 11, 2014 (DE) ..... 10 2014 202 477

(51) Int. Cl.

| | |
|---|---|
| ***G10K 11/168*** | (2006.01) |
| ***E04B 1/86*** | (2006.01) |
| ***G10K 11/162*** | (2006.01) |
| ***A47B 96/02*** | (2006.01) |

(Continued)

(52) U.S. Cl.
CPC ..... *G10K 11/168* (2013.01); *A47B 96/02* (2013.01); *A47B 96/205* (2013.01); *E04B 1/86* (2013.01); *G10K 11/162* (2013.01); *A47B 2220/13* (2013.01); *E04B 2001/848* (2013.01); *E04B 2001/849* (2013.01)

(58) Field of Classification Search
CPC .... G10K 11/168; G10K 11/162; A47B 96/02; A47B 96/205; E04B 1/86
USPC ..... 181/290, 292, 293, 294
See application file for complete search history.

(56) References Cited

U.S. PATENT DOCUMENTS 2,008,718 A * 7/1935 Jenkins ..... C04B 28/04 156/246
2,132,642 A * 10/1938 Parsons ..... E04B 1/86 138/DIG. 4

(Continued)

FOREIGN PATENT DOCUMENTS

DE 36 43 481 C2 11/1989
DE 93 12 734 U1 1/1995

(Continued)

*Primary Examiner* — Jeremy Luks
(74) *Attorney, Agent, or Firm* — Maschoff Brennan

(57) ABSTRACT

The invention relates to an acoustic absorber comprising a support (2) which comprises a plurality of recesses (22), and a coating (3) on a visible side (21) of the support (2), said coating covering the recesses (22) and being made from a lacquer. According to the invention the sections (31) of the coating (3), which cover the recesses (22), forming respectively at least two segments (311) which are separate from each other due to an opening (312), are foam or air-permeable. The invention also relates to the use of said type of absorber as a surface-covering element, as a ceiling or wall element or as part of a piece of equipment.

16 Claims, 9 Drawing Sheets

(51) Int. Cl.
*A47B 96/20* (2006.01)
*E04B 1/84* (2006.01)

(56) References Cited

U.S. PATENT DOCUMENTS

| | | | | | |
|---|---|---|---|---|---|
| 2,459,121 | A * | 1/1949 | Willey | E04B 1/86 | 181/293 |
| 2,959,242 | A * | 11/1960 | Muller | E04B 1/8409 | 156/71 |
| 5,888,626 | A | 3/1999 | Sensenig | | |
| 5,910,082 | A * | 6/1999 | Bender | E04B 1/86 | 181/284 |
| 6,033,756 | A | 3/2000 | Handscomb | | |
| 6,244,378 | B1 | 6/2001 | McGrath | | |
| 7,721,847 | B2 * | 5/2010 | Coury | E04B 9/001 | 181/293 |
| 2015/0090526 | A1 * | 4/2015 | Sasaki | E04B 1/86 | 181/294 |

FOREIGN PATENT DOCUMENTS

| | | | |
|---|---|---|---|
| DE | 43 32 845 | A1 | 3/1995 |
| DE | 43 32 856 | A1 | 3/1995 |
| EP | 0 246 464 | B1 | 10/1990 |
| EP | 0 640 951 | B1 | 4/1999 |
| JP | 2012-255967 | A | 12/2012 |
| WO | 99/63169 | A2 | 12/1999 |

* cited by examiner

ACOUSTIC ABSORBER AND USE OF SAID TYPE OF ACOUSTIC ABSORBER

The invention relates to an acoustic absorber according to the preamble of claim 1 as well as to the use of such an acoustic absorber according to claim 13.

Acoustic absorbers for absorbing sound waves or for the acoustical design of rooms, which are realized in the form of a plate provided with openings, are known in the prior art. For example, DE 43 32 856 A1 discloses a perforated metal plate coated with a porous lacquer layer as a sound absorber.

The problem underlying the invention consists in facilitating a sound absorption system which is providable in as simple a manner as possible and is nevertheless as efficient as possible.

Said problem is solved by the acoustic absorber with the features of claim 1 as well as by the use of such an absorber according to claim 13. Further developments of the invention are provided in the dependent claims.

An acoustic absorber is accordingly provided, having

- a carrier which comprises a plurality of recesses; as well as
- a coating which is formed from a lacquer and covers the recesses,
- wherein those portions of the coating, which cover the recesses, realize in each case at least two segments which are separated from one another by means of an opening, are realized as foam or in an airtight manner.

The coating is effected in particular on a "visible surface" of the carrier, i.e. a surface of the carrier that is visible once the absorber has been mounted, that is to say, for example, faces away from a mounting point (for instance a wall). For example, the visible surface of the absorber is also the surface which is to face a sound source. It is also conceivable for the coating to be provided on several surfaces of the carrier, in particular on surfaces that face one another.

Sound waves which impact upon the absorber enter the recesses of the carrier in part, sound energy being dissipated and the sound waves being correspondingly damped. By covering the openings with the lacquer coating, said effect is reinforced. This is as a result, for example, of the lacquer coating comprising, above the recesses in each case, at least one opening which brings about the narrowing of the recess and consequently increased dissipation of the sound energy (induced by friction).

The variant of the invention, according to which the portions of the coating covering the recesses are realized in an airtight manner, is able to be used, in particular, when the mass per unit area of the coating is small. The airtight design of the coating segments has the advantage, in particular, of producing a substantially homogeneous planar surface which, for example, is able to be cleaned in a simple manner.

In the variant of the invention, according to which the lacquer layer realizes, in the region of the recesses, in each case at least two segments which are separated from one another, the segments can be realized in each case in an at least substantially closed manner. This means, in particular, that the segments (or, for example, also the entire coating) do not comprise any open-pore lacquer material.

According to a development of the invention, at least some of the recesses extend in a slot-like manner, i.e. they comprise a longitudinal extension which is greater (e.g. three times greater) than their width. The openings in the lacquer layer are realized, for instance, in each case in the form of a gap which extends transversely with respect to the slots, the gaps, for example, having in each case a width of between 0.1 and 0.2 mm. Said particular structure of the lacquer coating in the region of the recesses can be generated in particular by the design of the edges of the recesses and/or of the dimensioning of the recesses. For instance, when generating the lacquer layer (for example in the form of powder lacquering or dip lacquering), the lacquer is pulled somewhat into the recesses on account of capillary effects and in this case opens up transversely with respect to the recesses, as a result of which the segments, which are separate from one another, of the portions of the lacquer coating covering the recesses are generated. It is also possible for closure elements, which serve to stabilize the lacquer coating in the region of the recesses, to be inserted into the recesses prior to applying the lacquer coating. The closure elements can remain in the recesses once the lacquer coating has been generated or are also able to be removed.

It is also conceivable for at least some of the recesses to be realized in cross section in an approximately circular manner, i.e. as bores. The recesses pass in particular through the entire carrier.

It is also conceivable for the recesses to be arranged in a regular pattern and/or, for example, to serve for showing image information, in particular for the graphic representation of an object. For instance, the recesses (in particular in the manner of a perforation) are arranged along a plurality of lines (contour lines) which show the contour of an object. The recesses do not have to comprise the same form, size and/or geometry. In addition, it is also possible for the spacings between adjacent recesses to vary. It is also possible for several (e.g. different) lacquer coatings to be arranged one on top of another, each of the lacquer layers comprising recesses. The recesses of the various lacquer layers are arranged, in particular, in such a manner that they overlap one another at least in part.

The carrier can be realized at least in part in a planar manner. However, the invention is naturally not restricted to a certain nature of the carrier. Also conceivable, for example, is that the carrier is realized in an arched, folded or stepped manner at least in portions. In addition, the basic form of the carrier (in top view) does not have to be rectangular. Rather, arbitrary basic forms are possible (e.g. round or serrated). The carrier is, for example, a metal or plastics material plate.

The invention also relates to the use of an acoustic absorber, which is designed as described above, as a surface-covering element, as a ceiling or wall element or as part of a fitment.

In addition, the invention relates to a fitment having an acoustic absorber which is designed as described above. The fitment is, for example, a shelf (for instance a shop shelf or a presentation shelf). It is conceivable in particular for bases of the shelf and/or at least one rear wall element to be formed in each case by an acoustic absorber according to the invention. It is also possible for all the bases and the rear wall to be formed in each case by an absorber according to the invention.

The invention is explained in more detail below by way of exemplary embodiments with reference to the figures, in which.

Figure 1:
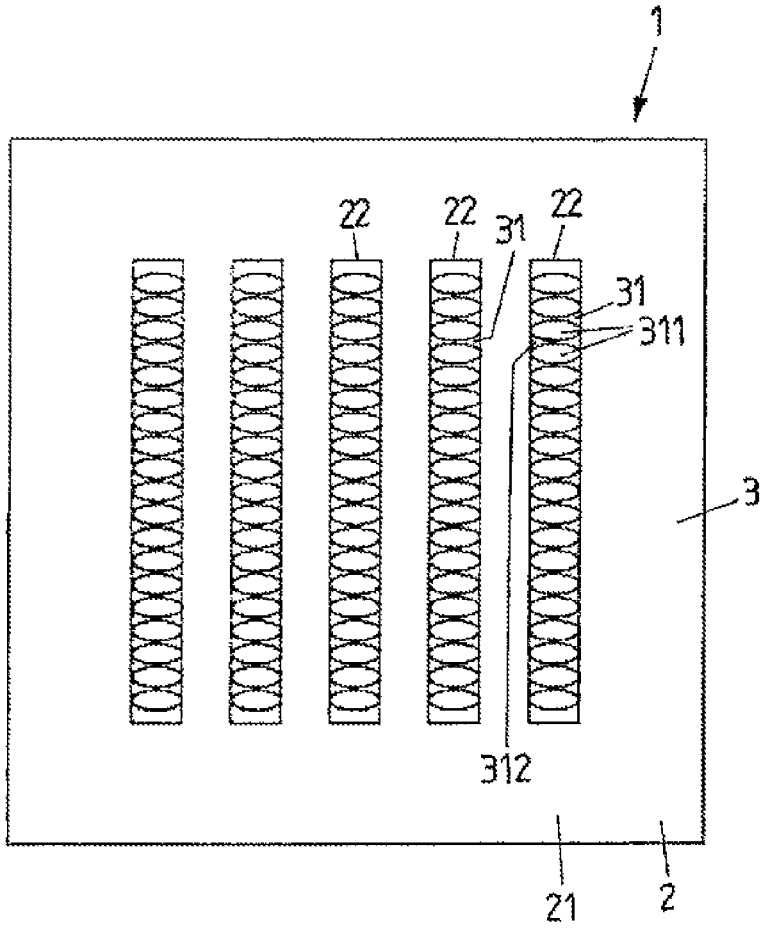
FIG. 1 shows a top view of an acoustic absorber according to a first exemplary embodiment of the invention.

FIG. 1 shows a top view of a visible surface 21 of a carrier 2 of an acoustic absorber 1 according to the invention. The carrier 2 comprises a plurality of recesses in the form of slots 22 which bring about increased energy dissipation of sound waves which impact upon the absorber 1.

The visible surface 21 of the carrier 2 is provided with a lacquer coating 3 which covers at least some of the slots 22 by way of portions 31. The portions 31 of the lacquer coating 3 are pulled somewhat into the respective slot 22 on account of the action of capillary forces. Over and above this, the portions 31 comprise in each case several segments 311 which are separated from one another by openings, in the form of gaps 312, which extend transversely with respect to the longitudinal extension of the slots 22.

The gaps 312 reduce the size of the slots 22 in their upper region, as a result of which the dissipation of sound wave energy is increased. The gaps 312 are generated in particular during the generation of the lacquer layer 3, the number of gaps depending, for instance, on the width of the slots 22 and/or on the nature of the edges of the slots. It is pointed out that the gaps 312, as shown in FIG. 1, do not necessarily have to have a constant width. In the present case, the gaps 312 widen outward (toward side walls of the slots 22) in each case from their center (in the center of the slots 22).

It is pointed out that in place of the slots 22 (at least in place of some of the slots 22) it is also possible to use recesses with a different geometry, e.g. circular bores or star-shaped openings. The recesses (in particular the slots 22) are able to be generated in principle in an arbitrary manner, e.g. cut, split, punched, sintered or etched.

The carrier 2 is, in particular, a material plate (e.g. a metal plate). However, it is also conceivable for the carrier to be a foil, a bar arrangement or wires with joins (as recesses), fibers, threads with joins or non-woven fabric, fleece, woven fabric, knitted goods where the spaces between joins (i.e. the spaces between fibers or threads) are chosen such that they are able to be bridged by the lacquer coating 3 (produced by way of an arbitrary coating method).

Figure 2:
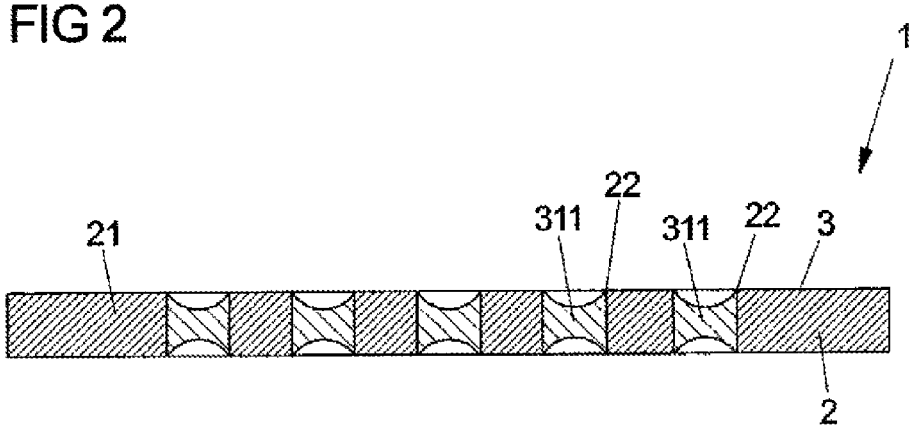
FIG. 2 shows the absorber of FIG. 1 in cross section.
Figure 3:
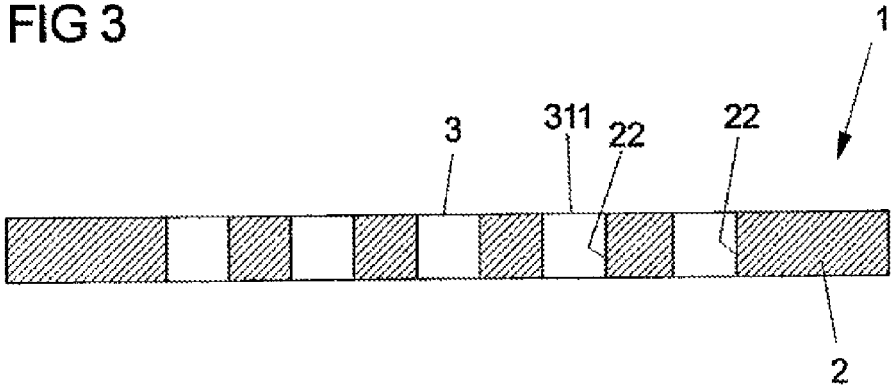
FIG. 3 shows a cross section of a modification of the acoustic absorber of FIGS. 1 and 2.

FIG. 2 shows the absorber 1 of FIG. 1 in cross section. It can be seen that the lacquer coating 3, as mentioned, is in each case pulled into the slots 22 and correspondingly comprises indentations in the region of the slots 22. However, it is also conceivable for the coating 3 to extend in a planar manner, as shown in the alternative cross section in FIG. 3. The coating 3 in FIG. 3 is, for example, a coating which closes the slots 22 in each case in an at least approximately airtight manner.

Figure 4:
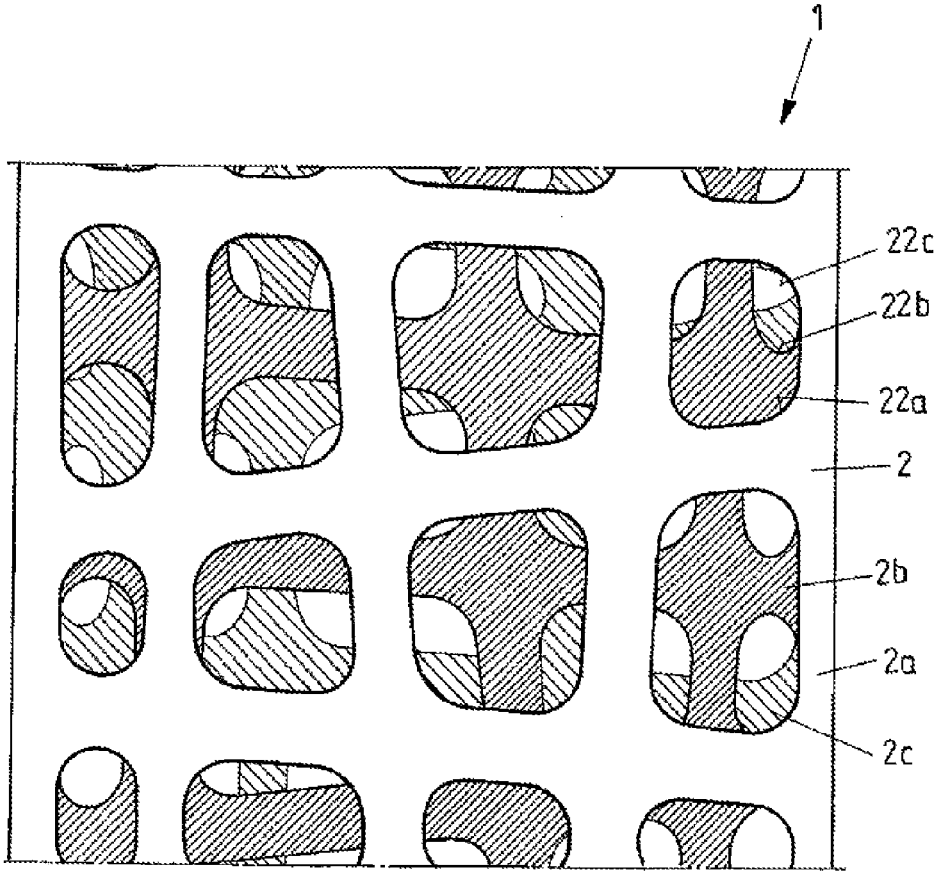
FIG. 4 shows a top view of an acoustic absorber according to a second exemplary embodiment of the invention.
Figure 5:
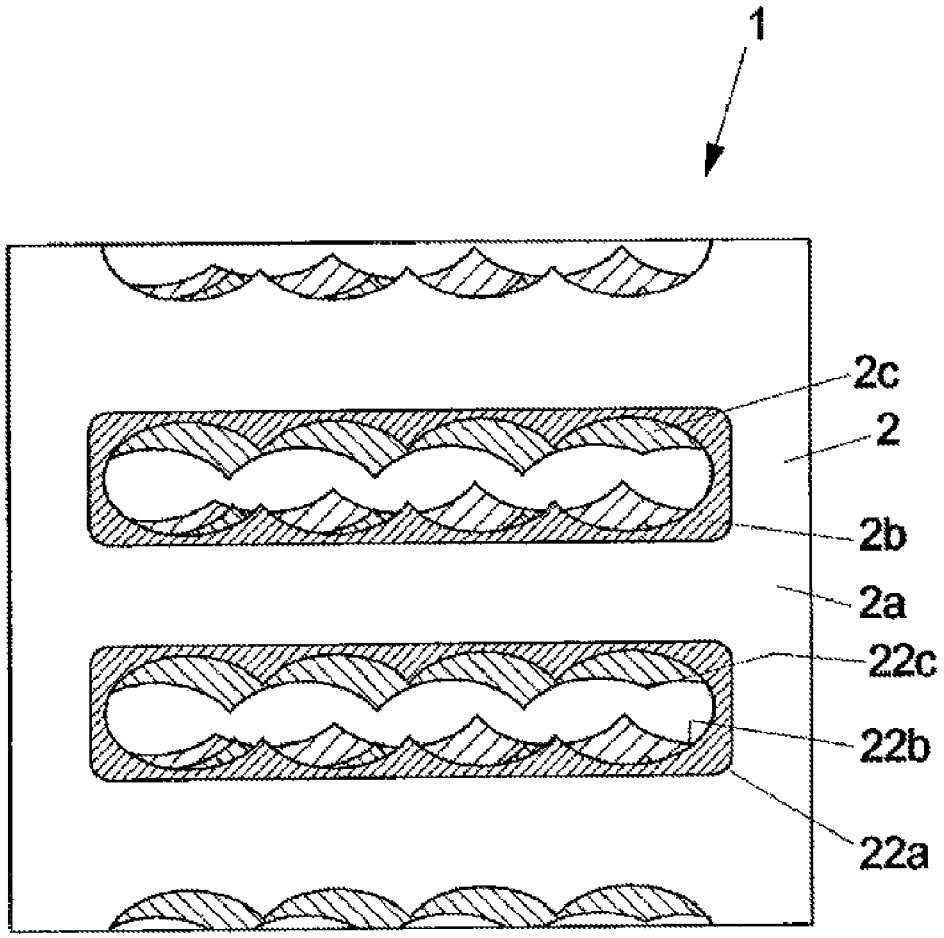
FIG. 5 shows a modification of the absorber of FIG. 4.

FIG. 4 shows a further exemplary embodiment of the absorber 1 according to the invention. The carrier 2 of the acoustic absorber 1 accordingly comprises several layers 2*a*-2*c*. The layers 2*a*-2*c* have in each case recesses 22*a*-22*c* which are in alignment with one another in part and consequently form the (sound-damping) recesses of the carrier 2. The visible surface of the carrier 2 is provided with a lacquer coating as above with reference to the other exemplary embodiments (or comprises a foamed or airtight lacquer layer in the region of the recesses 22*a*-22*c*). The recesses 22*a*-22*c* can be developed and arranged in principle in an arbitrary manner. FIG. 5 shows a different possible configuration.

Figure 6:
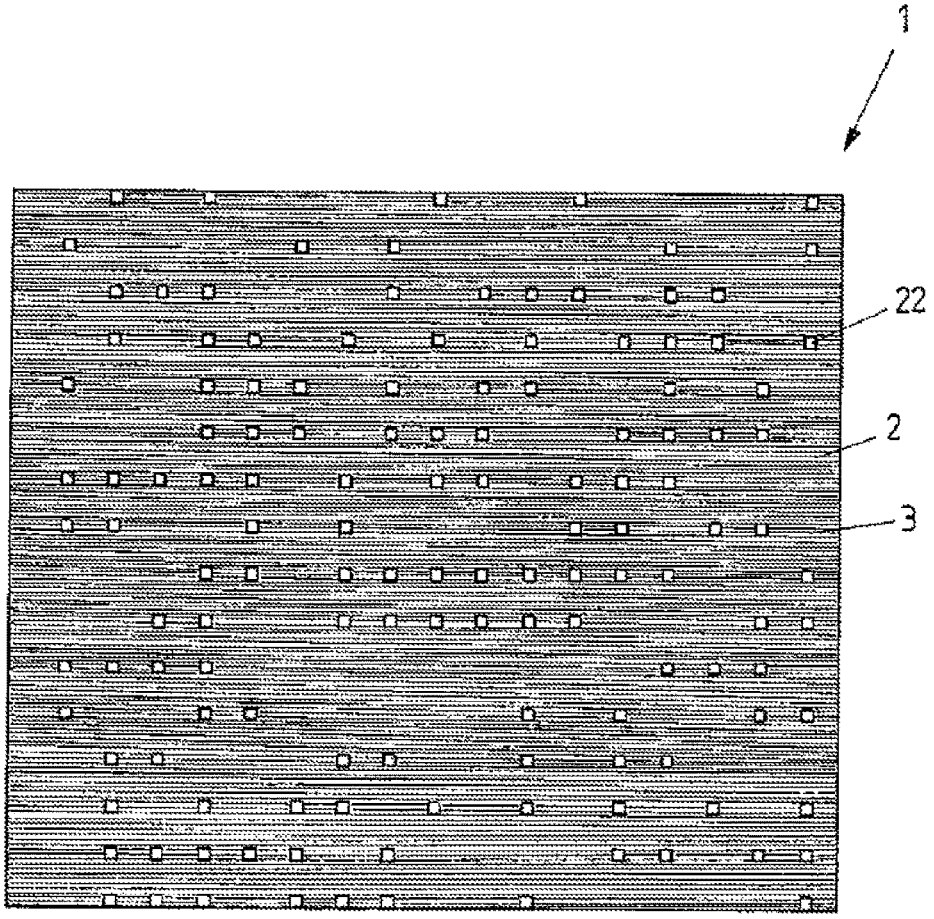
FIG. 6 shows a top view of an acoustic absorber according to a third exemplary embodiment of the invention.

FIG. 6 shows an absorber 1 according to the invention having an irregular arrangement of (rectangular) recesses 22. The recesses 22 are arranged in particular with regard to optimized sound absorption.

Figure 7:
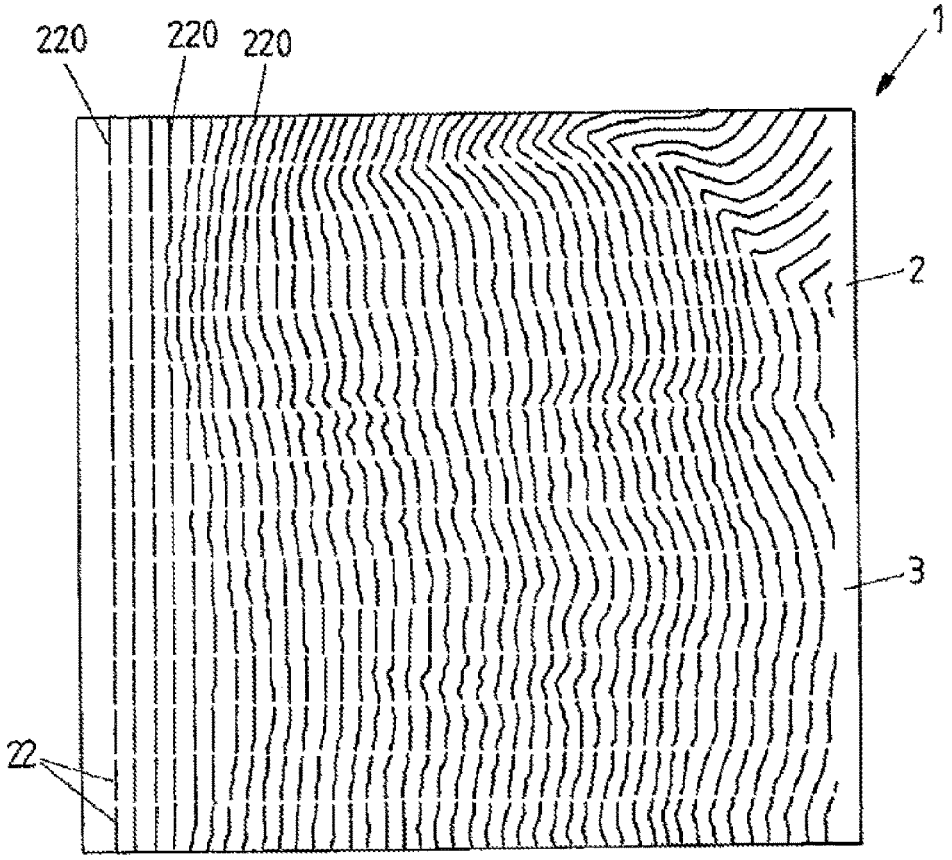
FIG. 7 shows a top view of an acoustic absorber according to a fourth exemplary embodiment of the invention.

FIG. 7 shows a further possibility of the arrangement of the recesses in the carrier 2. The recesses are accordingly realized in the form of a plurality (not resolved in FIG. 7) of bores 22 (perforations with a small diameter) which are arranged along several lines 220. The lines are realized, in particular, as contour lines such that a contour image is generated which serves for the decorative development of the visible surface of the carrier 2.

Figure 8:
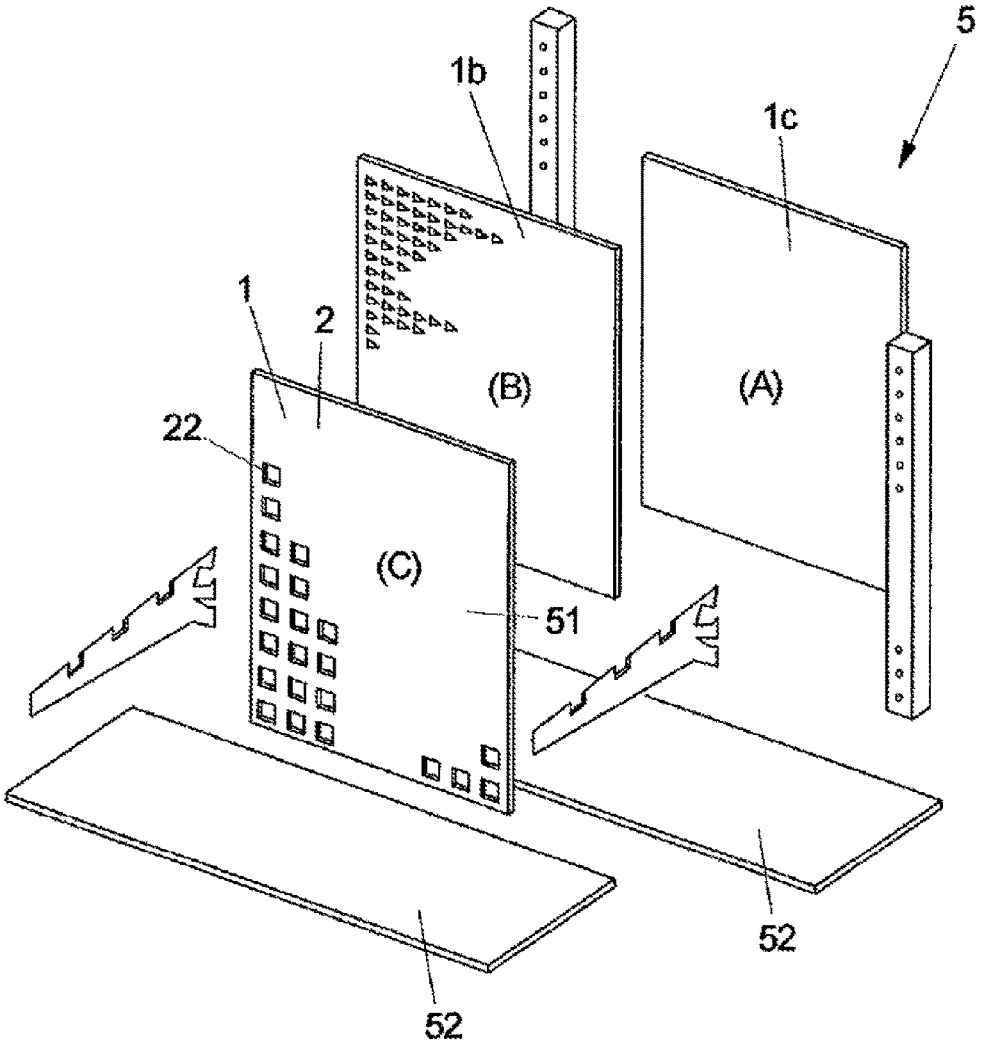
FIG. 8 shows an exploded representation of a shelf having an acoustic absorber according to the invention.

The acoustic absorbers 1 shown in the preceding figures are able to be used, in particular, as an element of an item of furniture, for instance of a shelf 5, as shown in an exploded representation in FIG. 8. In this case, a rear wall 51 of the shelf is formed from at least one absorber 1 according to the invention, it being possible to use differently configured absorbers 1*a*, 1*b* (for instance with differently shaped recesses) in place of the absorber 1. It is also conceivable for bases 52 of the shelf 5 also to be configured in each case by absorbers 1 according to the invention.

Figure 9:
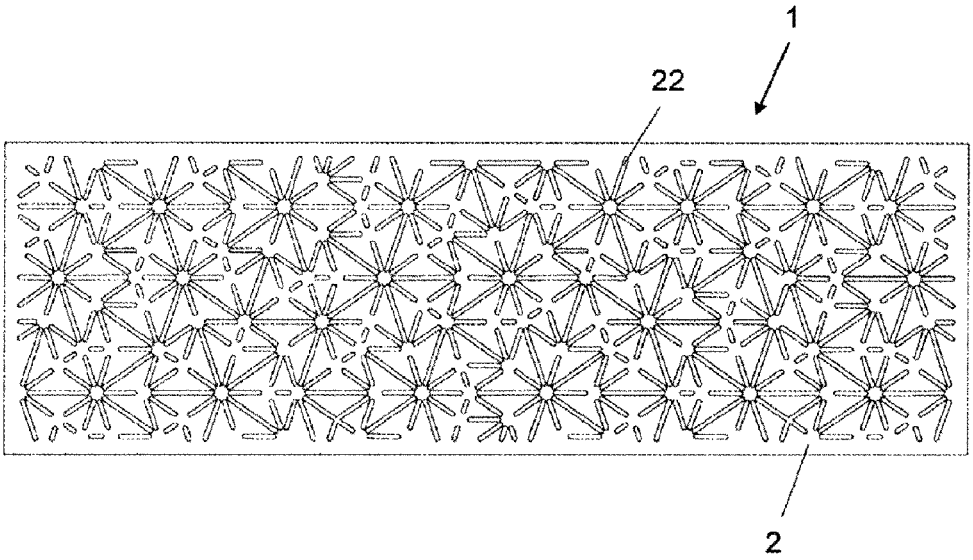
FIGS. 9 and 10 show acoustic absorbers according to further exemplary embodiments of the invention.

Similarly to FIGS. 6 and 7, FIG. 9 shows a top view of an absorber 1 according to the invention (or a part region of such an absorber), the absorber 1 comprising a plurality of recesses 22 which are arranged in a pattern.

Figure 10:
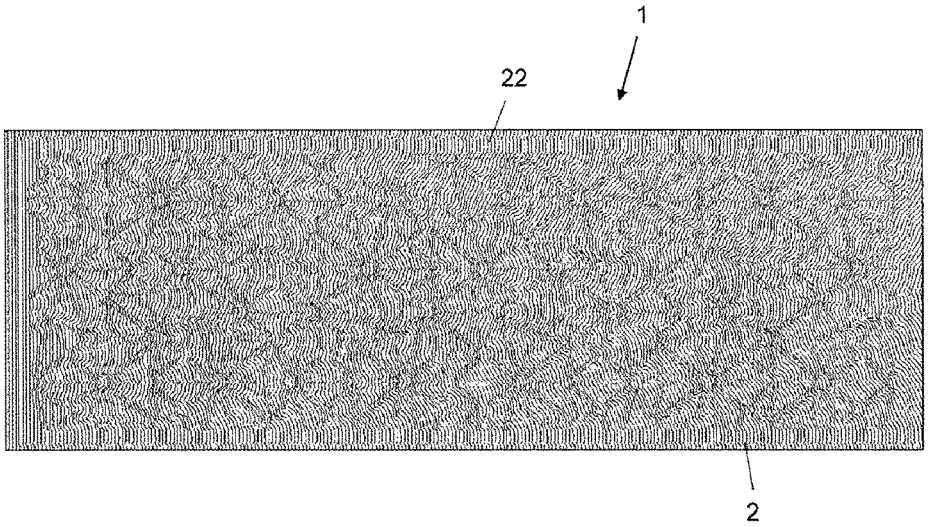

FIG. 10 also shows a top view of an absorber 1 according to the invention, the absorber 1 including, in an analogous manner to FIG. 7, a plurality of line-like recesses 22 which extend in a substantially vertical manner and extend in such a manner that they provide the pattern in FIG. 9. Said technique is naturally able to be applied in patterns that are in principle arbitrary or to objects that are to be shown in another manner. In particular, two adjacent lines extend substantially parallel to one another.

In particular, the development of the line-like recesses 22 is calculated such that as high a level as possible of sound diffusivity and/or sound absorption is produced. In this case, the lines 22, as shown in FIG. 10, can extend such that they allow an image to be seen. This is, however, not compulsory. The line-like recesses 22 can be realized as continuous or intermittent lines in the form of micro-gaps in the absorber 1.

For example, the development of the line-like recesses 22 is calculated on the basis of the development of wave fronts of a spreading wave (in particular using suitable differential equations), an image or pattern which, where applicable, is to be shown by recesses, being considered to a certain extent as a barrier to the wave.

The invention claimed is:

1. An acoustic absorber, comprising:

a carrier including a plurality of recesses; and a coating formed from a lacquer and covering the plurality of recesses, wherein for portions of the coating which cover the recesses, the portions include at least two segments separated from one another via an opening, wherein the at least two segments reduce a size of at least one recess of the plurality of recesses.

2. The acoustic absorber as claimed in claim 1, wherein the at least two segments are realized in an at least substantially closed manner.

3. The acoustic absorber as claimed in claim 1, wherein at least some of the recesses of the plurality of recesses extend in a slot-like manner.

4. The acoustic absorber as claimed in claim 3, wherein the opening is realized in the form of a gap which extends transversely with respect to a slot.

5. The acoustic absorber as claimed in claim 4, wherein the gap has a width of approximately between 0.1 and 0.2 mm.

6. The acoustic absorber as claimed in claim 1, wherein at least some of the recesses of the plurality of recesses are realized at least approximately circular in cross section.

7. The acoustic absorber as claimed in claim 1, wherein the plurality of recesses are arranged in a regular pattern.

8. The acoustic absorber as claimed in claim 1, wherein the plurality of recesses are arranged in such a manner that they produce a graphic representation of an object.

9. The acoustic absorber as claimed in claim 1, wherein the plurality of recesses are arranged along a plurality of lines.

10. The acoustic absorber as claimed in claim 1, wherein the carrier is realized in an at least substantially planar manner.

11. The acoustic absorber as claimed in claim 1, wherein the carrier is realized in an arched, folded or stepped manner.

12. The acoustic absorber as claimed in claim 1, wherein the carrier comprises a metal or plastics material plate.

13. A method of using an acoustic absorber as claimed in claim 1, as a surface-covering element, as a ceiling or wall element or as part of a fitment.

14. A fitment having at least one acoustic absorber as claimed in claim 1.

15. The fitment as claimed in claim 14, wherein the fitment comprises a shelf.

16. The fitment as claimed in claim 15, wherein one or more bases of the shelf and/or at least one rear wall element are formed by an acoustic absorber that includes:

a carrier including a plurality of recesses; and a coating formed from a lacquer and covering the plurality of recesses, wherein for portions of the coating which cover the recesses, the portions include at least two segments separated from one another via an opening, wherein the at least two segments reduce a size of at least one recess of the plurality of recesses.

* * * * *